US010852046B2

(12) United States Patent
Scalf

(10) Patent No.: US 10,852,046 B2
(45) Date of Patent: Dec. 1, 2020

(54) REFRIGERATOR WITH DOOR-MOUNTED FLUID DISPENSER

(71) Applicant: Midea Group Co., Ltd., Foshan (CN)

(72) Inventor: Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 115 days.

(21) Appl. No.: 16/215,005

(22) Filed: Dec. 10, 2018

(65) Prior Publication Data

US 2020/0182525 A1 Jun. 11, 2020

(51) Int. Cl.

*F25B 1/00* (2006.01)
*F25C 5/20* (2018.01)
*F25D 23/12* (2006.01)

(52) U.S. Cl.

CPC ..... *F25C 5/22* (2018.01); *F25D 23/126* (2013.01); *F25C 2600/04* (2013.01); *F25D 2323/121* (2013.01); *F25D 2323/122* (2013.01); *F25D 2400/361* (2013.01)

(58) Field of Classification Search

CPC .. F25C 2600/04; F25C 5/22; F25D 2323/121; F25D 2323/122

See application file for complete search history.

(56) References Cited

U.S. PATENT DOCUMENTS 2,504,622 A 4/1950 Band
2,869,714 A 1/1959 Williams
2,914,218 A 11/1959 Korodi
3,146,601 A 9/1964 Gould
3,187,958 A 6/1965 Swart
3,218,111 A 11/1965 Steiner
3,351,233 A 11/1967 Chanoch et al.
3,602,007 A 8/1971 Drieci
3,640,433 A 2/1972 Rodth
3,643,464 A 2/1972 Hilliker et al.
3,744,270 A 7/1973 Wilcox
3,785,512 A 1/1974 Gatz et al.
3,798,923 A 3/1974 Pink et al.
3,874,559 A 4/1975 Pink
3,911,692 A 10/1975 Maxwell et al.
4,084,725 A 4/1978 Buchser
4,129,015 A 12/1978 Morris, Jr.
4,168,805 A 9/1979 Taylor
4,189,063 A 2/1980 Matthiesen (Continued)

FOREIGN PATENT DOCUMENTS

CN 1648561 A 8/2005
CN 1690621 A 11/2005

(Continued)

OTHER PUBLICATIONS

U.S. Patent and Trademark Office, Final Office Action issued in U.S. Appl. No. 15/836,035 dated May 14, 2020.

(Continued)

*Primary Examiner* — Filip Zec
(74) *Attorney, Agent, or Firm* — Middleton Reutlinger

(57) ABSTRACT

A refrigerator combines an externally-accessible door-mounted fluid or water dispenser outlet with an externally-accessible case-mounted ice dispenser outlet and/or an externally-accessible case-mounted fluid dispenser control.

26 Claims, 4 Drawing Sheets

(56) References Cited

U.S. PATENT DOCUMENTS

| | | | | |
|---|---|---|---|---|
| 4,227,383 | A | 10/1980 | Horway | |
| 4,306,757 | A | 12/1981 | Horway et al. | |
| 4,333,612 | A | 6/1982 | Hayashi | |
| 4,420,948 | A | 12/1983 | Savage | |
| 4,790,146 | A | 12/1988 | Mun et al. | |
| 4,804,111 | A | 2/1989 | Ricciardi et al. | |
| 4,942,983 | A | 7/1990 | Bradbury | |
| 5,149,551 | A | 9/1992 | Anderson | |
| 6,019,447 | A | 2/2000 | Jackovin | |
| 6,574,984 | B1 | 6/2003 | McCrea et al. | |
| 6,860,408 | B2 | 3/2005 | Hawkes | |
| 7,137,582 | B1 | 11/2006 | Mikkelsen et al. | |
| 7,188,479 | B2 | 3/2007 | Anselmino et al. | |
| 7,228,702 | B2 * | 6/2007 | Maglinger | F25C 5/005 62/344 |
| 7,284,390 | B2 | 10/2007 | Van Meter et al. | |
| 7,318,633 | B2 | 1/2008 | Shin et al. | |
| 7,337,620 | B2 | 3/2008 | Coulter et al. | |
| 7,343,757 | B2 | 3/2008 | Egan et al. | |
| 7,386,992 | B2 | 6/2008 | Adamski et al. | |
| 7,455,085 | B2 | 11/2008 | Voglewede et al. | |
| 7,475,562 | B2 | 1/2009 | Jackovin | |
| 7,493,774 | B2 | 2/2009 | Ferragut, II et al. | |
| 7,591,399 | B2 | 9/2009 | Hortin et al. | |
| 7,658,212 | B2 | 2/2010 | Meuleners et al. | |
| 7,673,471 | B2 | 3/2010 | Egan et al. | |
| 7,707,847 | B2 | 5/2010 | Davis et al. | |
| 7,712,321 | B2 | 5/2010 | Kadyk | |
| 7,997,452 | B2 | 8/2011 | Kim et al. | |
| 8,001,796 | B2 | 8/2011 | Kim et al. | |
| 8,006,502 | B2 | 8/2011 | Kim et al. | |
| 8,191,378 | B2 | 6/2012 | Park | |
| 8,191,379 | B2 | 6/2012 | Wuesthoff et al. | |
| 8,196,618 | B2 | 6/2012 | Kim et al. | |
| 8,201,715 | B2 | 6/2012 | Park et al. | |
| 8,312,735 | B2 | 11/2012 | Fulton | |
| 8,336,330 | B2 | 12/2012 | Lee et al. | |
| 8,353,177 | B2 | 1/2013 | Adamski et al. | |
| 8,454,103 | B2 | 6/2013 | Jeon et al. | |
| 8,499,577 | B2 | 8/2013 | Watson et al. | |
| 8,516,845 | B2 | 8/2013 | Wuesthoff et al. | |
| 8,459,055 | B2 | 11/2013 | Kim et al. | |
| 8,596,085 | B2 | 12/2013 | Koo et al. | |
| 8,616,019 | B2 | 12/2013 | Van Meter et al. | |
| 8,656,731 | B2 * | 2/2014 | Kim | F25D 23/126 62/389 |
| 8,701,428 | B2 | 4/2014 | Lee et al. | |
| 8,701,436 | B2 | 4/2014 | Kim | |
| 8,707,726 | B2 | 4/2014 | Lim et al. | |
| 8,733,123 | B2 | 5/2014 | Adamski et al. | |
| 8,756,952 | B2 | 6/2014 | Adamski et al. | |
| 8,806,884 | B2 | 8/2014 | Park et al. | |
| 9,068,772 | B2 | 6/2015 | Yeo et al. | |
| 9,085,453 | B2 | 7/2015 | McMahan et al. | |
| 9,284,179 | B2 | 3/2016 | Clancy et al. | |
| 9,476,631 | B2 | 10/2016 | Park et al. | |
| 9,593,875 | B2 | 3/2017 | Van Meter et al. | |
| 9,683,771 | B2 | 6/2017 | Anselmino et al. | |
| 9,791,198 | B2 | 10/2017 | Jeong et al. | |
| 10,119,747 | B2 | 11/2018 | You et al. | |
| 2004/0007009 | A1 | 1/2004 | Wing et al. | |
| 2005/0178273 | A1 | 8/2005 | Meuleners et al. | |
| 2005/0268638 | A1 | 12/2005 | Voglewede et al. | |
| 2006/0086132 | A1 | 4/2006 | Maglinger et al. | |
| 2006/0090496 | A1 | 5/2006 | Adamski et al. | |
| 2006/0162369 | A1 | 7/2006 | Chae | |
| 2006/0272347 | A1 | 12/2006 | Park | |
| 2007/0033960 | A1 | 2/2007 | Egan et al. | |
| 2007/0113578 | A1 | 5/2007 | Wu et al. | |
| 2007/0204643 | A1 | 9/2007 | Harris | |
| 2008/0174220 | A1 | 7/2008 | Kim et al. | |
| 2008/0272679 | A1 | 11/2008 | Wuesthoff et al. | |
| 2008/0314065 | A1 | 12/2008 | Kim | |
| 2009/0008403 | A1 | 1/2009 | Lee et al. | |
| 2009/0009042 | A1 | 1/2009 | Kim et al. | |
| 2009/0031751 | A1 * | 2/2009 | Ayvazoglu | F25C 5/22 62/344 |
| 2009/0229284 | A1 | 9/2009 | Fulton et al. | |
| 2010/0037631 | A1 | 2/2010 | Choi et al. | |
| 2010/0050681 | A1 | 3/2010 | Ryu et al. | |
| 2010/0082159 | A1 | 4/2010 | Kim et al. | |
| 2010/0293984 | A1 | 11/2010 | Adamski et al. | |
| 2011/0138821 | A1 | 6/2011 | Chase et al. | |
| 2011/0167862 | A1 | 7/2011 | Shin et al. | |
| 2011/0174008 | A1 | 7/2011 | Kim | |
| 2011/0239687 | A1 | 10/2011 | Lim et al. | |
| 2012/0031136 | A1 | 2/2012 | Park | |
| 2012/0036882 | A1 | 2/2012 | Park et al. | |
| 2012/0103002 | A1 | 5/2012 | Lee et al. | |
| 2013/0263620 | A1 | 10/2013 | An et al. | |
| 2013/0263621 | A1 | 10/2013 | An et al. | |
| 2014/0000303 | A1 | 1/2014 | Jeong et al. | |
| 2014/0251498 | A1 | 9/2014 | Park et al. | |
| 2014/0252938 | A1 | 9/2014 | Kim et al. | |
| 2014/0285082 | A1 | 9/2014 | Choi et al. | |
| 2016/0084560 | A1 | 3/2016 | Jeong et al. | |
| 2016/0265816 | A1 | 9/2016 | Gillette et al. | |
| 2016/0341462 | A1 | 11/2016 | Kim | |
| 2016/0370102 | A1 | 12/2016 | Yang | |
| 2017/0082339 | A1 | 3/2017 | Adamski et al. | |
| 2017/0082340 | A1 | 3/2017 | Adamski et al. | |
| 2017/0138659 | A1 | 5/2017 | Lee et al. | |
| 2017/0167780 | A1 | 6/2017 | Jeong et al. | |
| 2017/0174493 | A1 | 6/2017 | Aranda et al. | |
| 2017/0292751 | A1 * | 10/2017 | Lee | F25C 5/046 |
| 2017/0314832 | A1 | 11/2017 | Kim | |
| 2018/0149408 | A1 | 5/2018 | Akca et al. | |

FOREIGN PATENT DOCUMENTS

| | | | |
|---|---|---|---|
| CN | 1811308 | A | 8/2006 |
| CN | 101650105 | A | 2/2010 |
| CN | 102575891 | A | 7/2012 |
| CN | 107314600 | A | 11/2017 |
| CN | 108931095 | A | 12/2018 |
| JP | 2001153525 | A | 6/2001 |
| KR | 20060074931 | A | 7/2006 |
| KR | 101123710 | B1 | 3/2012 |
| WO | 1997029330 | A1 | 8/1997 |
| WO | 2014086401 | A1 | 6/2014 |

OTHER PUBLICATIONS

International Search Report and Written Opinion issued is Application No. PCT/CN2019/094349 dated Sep. 25, 2019.
U.S. Patent and Trademark Office, Non-Final Office Action issued in U.S. Appl. No. 15/835,953 dated Feb. 26, 2020.
International Search Report and Written Opinion issued in Application No. PCT/CN2018/074188 dated Aug. 20, 2018.
International Search Report and Written Opinion issued in Application No. PCT/CN2018/074255 dated Aug. 29, 2018.
Transmittal of Related Applications dated Dec. 14, 2018.
U.S. Patent and Trademark Office, Non-Final Office Action issued in related U.S. Appl. No. 15/836,035 dated Oct. 17, 2019. 20 Pages.
U.S. Patent and Trademark Office, Office Action issued in U.S. Appl. No. 15/835,953 dated Sep. 4, 2020.
U.S. Patent and Trademark Office, Advisory Action issued in U.S. Appl. No. 15/836,035 dated Aug. 18, 2020.
U.S. Patent and Trademark Office, Notice of Allowance issued in U.S. Appl. No. 15/836,035 dated Oct. 5, 2020.

* cited by examiner

REFRIGERATOR WITH DOOR-MOUNTED FLUID DISPENSER

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Many residential refrigerators also include as a convenience feature an integrated dispenser for dispensing a fluid (e.g., water) and/or ice. In addition, some refrigerators incorporate a water tank or other fluid storage receptacle that may be fixed or removable, and positioned within a cooled compartment of the refrigerator to cool the contained fluid prior to dispensing or otherwise serving (e.g., in the case where the receptacle is removable).

Generally, ice and water dispensers are integrated together to provide a user with a single location from which to dispense ice and water, as well as to configure and/or control the dispensers. In addition, common water lines are generally used to supply water to the water dispenser and to the icemaker that produces the ice dispensed by the ice dispenser, and a single filter may be used to filter the water used by both dispensers. For various reasons, however, integrating ice and water dispensers and their respective controls and/or water supplies together may prove to be unduly complicating in some specific applications, e.g., where it is desirable to dispense ice at a convenient height for a user in a bottom mount refrigerator that orients the freezer compartment below the fresh food compartment, and/or where it is desirable to provide a water tank or other fluid storage receptacle that is accessible by a user.

SUMMARY

The herein-described embodiments address these and other problems associated with the art by providing a refrigerator that combines an externally-accessible door-mounted fluid or water dispenser outlet with an externally-accessible case-mounted ice dispenser outlet and/or an externally-accessible case-mounted fluid dispenser control.

Therefore, consistent with one aspect of the invention, a refrigerator may include a cabinet including a case having one or more food storage compartments defined therein and one or more doors positioned to insulate the one or more food storage compartments from an exterior environment, the one or more food storage compartments including a fresh food compartment disposed above a freezer compartment, and the one or more doors defining a dispenser opening on a front side of the cabinet when the one or more doors are in a closed position, an icemaking console extending upwardly from a bottom wall of the fresh food compartment and positioned proximate the dispenser opening defined by the one or more doors, where the icemaking console extends only a portion of a height of the fresh food compartment and is spaced apart from each of a top wall, a first side wall, and a second side wall of the fresh food compartment, and where the icemaking console includes one or more walls that insulate an interior compartment of the icemaking console from the fresh food compartment, an icemaker disposed within the icemaking console, an ice dispenser disposed within the icemaking console and having an externally-accessible ice dispenser outlet positioned within the dispenser opening to dispense ice produced by the icemaker when the one or more doors are in a closed position, a water dispenser coupled to the cabinet and having an externally-accessible door-mounted water dispenser outlet coupled to a first door among the one or more doors to dispense water from the water dispenser when the one or more doors are in a closed position, and an externally-accessible case-mounted water dispenser control coupled to the cabinet and positioned within the dispenser opening to selectively activate the water dispenser in response to user input when the one or more doors are in a closed position.

Consistent with another aspect of the invention, a refrigerator may include a cabinet including a case having one or more food storage compartments defined therein and one or more doors positioned to insulate the one or more food storage compartments from an exterior environment, the one or more doors defining an ice dispenser opening on a front side of the cabinet when the one or more doors are in a closed position, an ice dispenser coupled to the cabinet and having an externally-accessible ice dispenser outlet positioned within the ice dispenser opening to dispense ice from a case-mounted icemaker when the one or more doors are in a closed position, and a fluid dispenser coupled to the cabinet and having an externally-accessible door-mounted fluid dispenser outlet coupled to a first door among the one or more doors to dispense fluid from the fluid dispenser when the one or more doors are in a closed position.

In some embodiments, the refrigerator is a bottom mount refrigerator, and the one or more food storage compartments includes a fresh food compartment disposed above a freezer compartment in the case. In addition, some embodiments may further include an icemaking console extending upwardly from a bottom wall of the fresh food compartment and positioned proximate the ice dispenser opening defined by the one or more doors, where the ice dispenser is disposed within the icemaking console. Also, in some embodiments, the icemaking console extends only a portion of a height of the fresh food compartment and is spaced apart from each of a top wall, a first side wall, and a second side wall of the fresh food compartment, and the icemaking console includes one or more walls that insulate an interior compartment of the icemaking console from the fresh food compartment.

Further, in some embodiments, the fluid dispenser includes a fluid supply line, a portion of which is routed through the first door. In some embodiments, the fluid supply line is further routed through a hinge of the first door that pivotably mounts the first door to the case. In addition, in some embodiments, the fluid dispenser further includes a fluid dispensing valve disposed upstream of the hinge and configured to dispense fluid through the fluid dispenser outlet when activated. In some embodiments, the fluid dispenser further includes a fluid dispensing valve disposed on the first door and configured to dispense fluid through the fluid dispenser outlet when activated.

In addition, in some embodiments, the fluid dispenser further includes a fluid storage receptacle disposed on the first door upstream of the fluid dispensing valve, and a receptacle fill valve disposed upstream of the fluid storage receptacle to fill the fluid storage receptacle with fluid when activated. Moreover, in some embodiments, the fluid storage receptacle is dockable into and removable from the first door.

Some embodiments may also include an externally-accessible fluid dispenser control coupled to the cabinet to selectively activate the fluid dispenser in response to user input. In some embodiments, the fluid dispenser control is disposed on the first door, where the first door includes a fluid dispenser recess configured to receive at least a portion of a container, and where the fluid dispenser outlet is disposed above the fluid dispenser recess. Moreover, in some embodiments, the fluid dispenser control is a case-mounted fluid dispenser control positioned within the opening to selectively activate the fluid dispenser in response to user input when the one or more doors are in a closed position.

In some embodiments, the fluid dispenser control includes a container-actuated control positioned for activation by a container when the container is placed below the fluid dispenser outlet. In addition, in some embodiments, the fluid dispenser control and the fluid dispenser outlet are both disposed proximate the ice dispenser outlet when the first door is in a closed position. In some embodiments, the fluid dispenser control further controls the ice dispenser, and the fluid dispenser control selectively activates one of the fluid dispenser and the ice dispenser in response to a user selected mode.

Some embodiments may further include a dispenser recess positioned within the ice dispenser opening to receive at least a portion of a container, where the ice dispenser outlet is disposed above the dispenser recess, and where the fluid dispenser outlet is positioned over the dispenser recess and proximate the ice dispenser outlet when the first door is in the closed position. Also, in some embodiments, the fluid dispenser is further configured to dispense fluid out of the fluid dispenser outlet when the first door is open to facilitate filling of containers that are too large to be received in the dispenser recess.

Some embodiments may also include a secondary fluid dispenser control disposed on the first door to activate the fluid dispenser when the first door is in an open position. In addition, in some embodiments, the fluid dispenser outlet is disposed on a downwardly-facing side of the first door and includes a portion that dispenses fluid in a direction that is generally parallel to a plane of the first door and outwardly from an end-facing side of the first door.

Consistent with another aspect of the invention, a refrigerator may include a cabinet including a case having one or more food storage compartments defined therein and one or more doors positioned to insulate the one or more food storage compartments from an exterior environment, the one or more doors defining an opening on a front side of the cabinet when the one or more doors are in a closed position, a fluid dispenser coupled to the cabinet and having an externally-accessible door-mounted fluid dispenser outlet coupled to a first door among the one or more doors to dispense fluid from the fluid dispenser when the one or more doors are in a closed position, and an externally-accessible case-mounted fluid dispenser control coupled to the cabinet and positioned within the opening to selectively activate the fluid dispenser in response to user input when the one or more doors are in a closed position.

In addition, some embodiments may further include an ice dispenser coupled to the cabinet and having an externally-accessible ice dispenser outlet positioned within the opening to dispense ice from a case-mounted icemaker when the one or more doors are in a closed position. Moreover, in some embodiments, the fluid dispenser control includes a container-actuated control positioned for activation by a container when the container is placed below the fluid dispenser outlet, where the fluid dispenser control and the fluid dispenser outlet are both disposed proximate the ice dispenser outlet when the first door is in a closed position. Further, in some embodiments, the fluid dispenser control further controls the ice dispenser, and the fluid dispenser control selectively activates one of the fluid dispenser and the ice dispenser in response to a user selected mode.

Also, in some embodiments, the fluid dispenser includes a fluid supply line, a portion of which is routed through the first door, a fluid dispensing valve disposed on the first door and configured to dispense fluid through the fluid dispenser outlet when activated, a fluid storage receptacle disposed on the first door upstream of the fluid dispensing valve, and a receptacle fill valve disposed upstream of the fluid storage receptacle to fill the fluid storage receptacle with fluid when activated.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
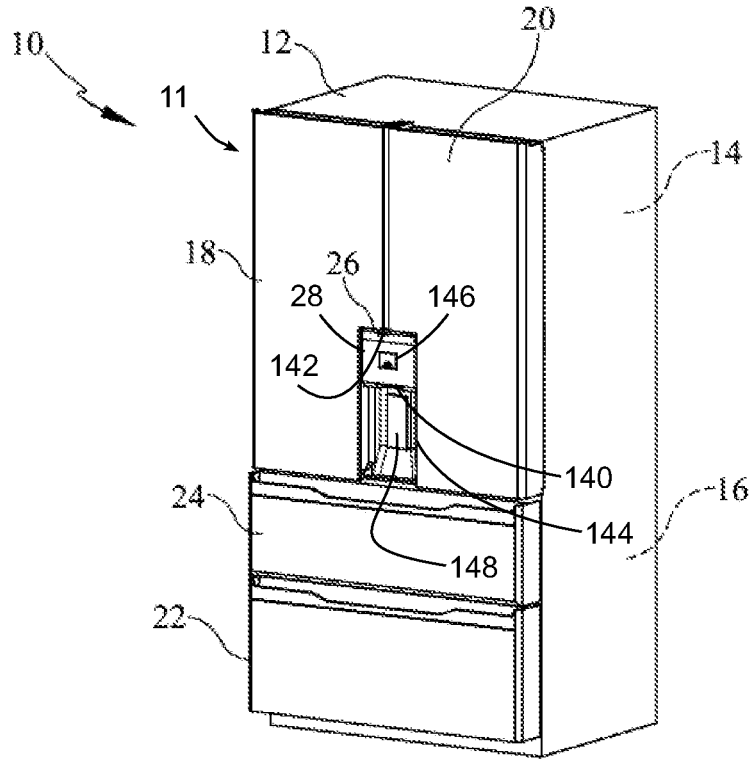
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet 11 including a case 12 (representing the fixed portion or main body of the refrigerator) having one or more food storage compartments (e.g., a fresh food compartment 14 and a freezer compartment 16), as well as one or more fresh food compartment doors 18, 20 and one or more freezer compartment doors 22, 24 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a pair of sliding freezer compartment doors 22, 24 that are similar to drawers and that pull out to provide access to items in the freezer compartment. Both the fresh food compartment and the freezer compartment may be considered to be full width as they extend substantially across the full width of the case 12. It will be appreciated, however, that other compartment door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a dispenser 26 for dispensing ice and/or a fluid such as water. In the illustrated embodiments, dispenser 26 is an ice and water dispenser capable of dispensing both ice (cubed and/or crushed) and chilled water, while in other embodiments, dispenser 26 may be a fluid only dispenser for dispensing various fluids such as chilled or cooled water, hot water, coffee, beverages, or other fluids, and may have variable rate and/or fast dispense capabilities, as well as an ability to dispense predetermined or measured quantities of fluids. In some instances, ice and water may be dispensed from the same location, while in other instances separate locations may be provided in the dispenser for dispensing ice and water.

Refrigerator 10 also includes a control panel 28, which in the illustrated embodiment forms at least a portion of an exterior surface of an ice compartment of case 12, and further is separate from a fresh food or freezer compartment door such as any of doors 18, 20, 22, and 24. Control panel 28 may include various input/output controls such as buttons, indicator lights, alphanumeric displays, dot matrix displays, touch-sensitive displays, etc. for interacting with a user. In other embodiments, control panel 28 may be separate from dispenser 26 (e.g., on a door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Figure 2:
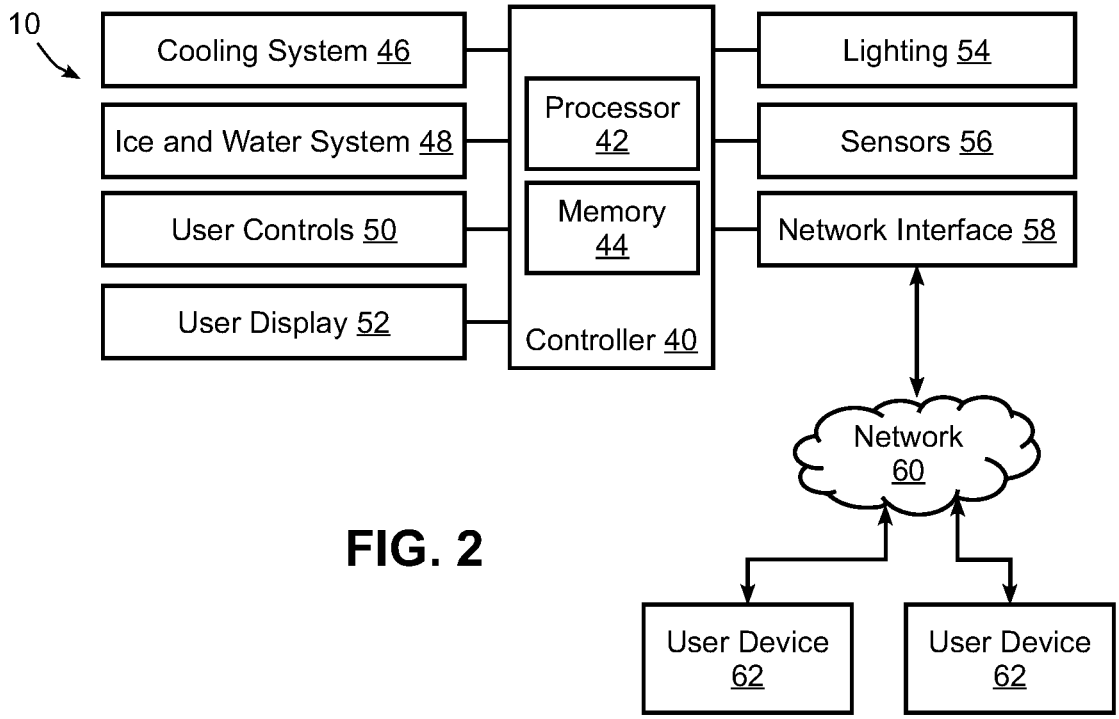
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. At least a portion of user controls 50 and user displays 52 may be disposed, for example, on control panel 28 of FIG. 1.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 3:
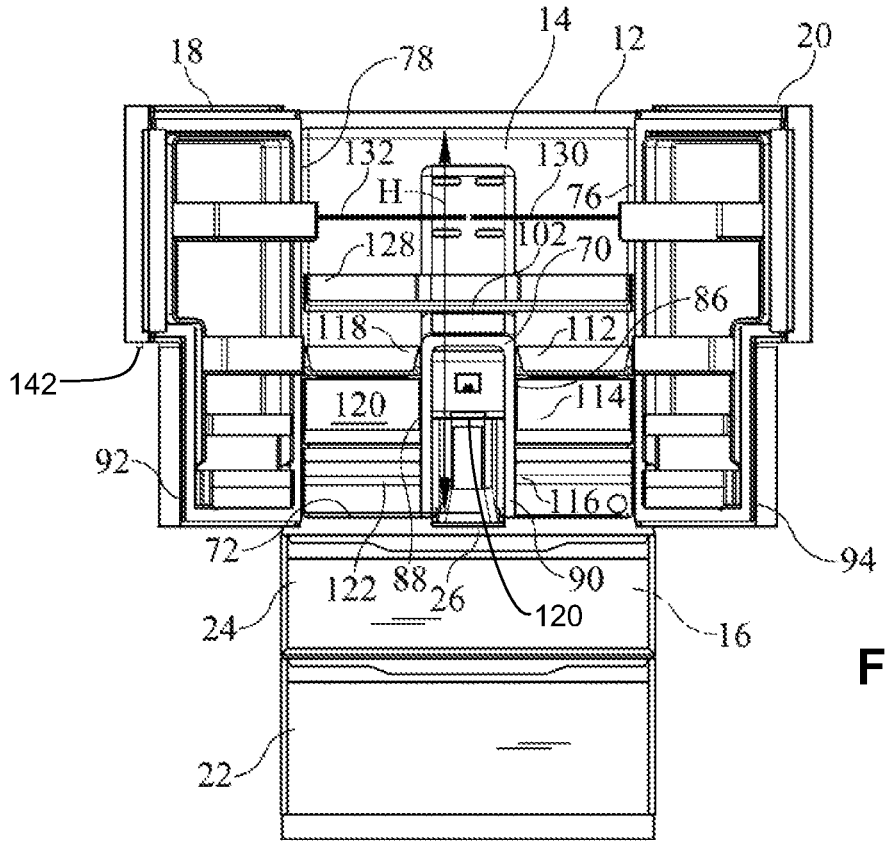
FIG. 3 is a front elevational view of the refrigerator of FIG. 1 with the fresh food compartment doors open.
Figure 4:
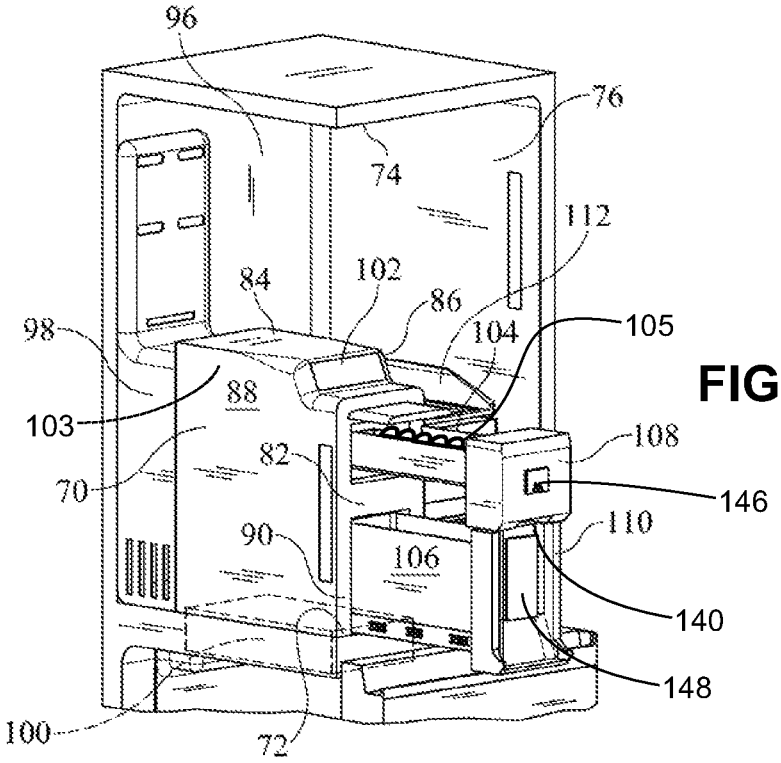
FIG. 4 is an exploded perspective view of the icemaking console for the refrigerator of FIG. 1.

Now turning to FIGS. 3 and 4, in some embodiments, a door-mounted fluid dispenser as described herein may be used in connection with an icemaking console disposed at least partially within a fresh food compartment and extending only a portion of the height of the fresh food compartment, e.g., as disclosed in U.S. patent application Ser. No. 15/835,953 and U.S. patent application Ser. No. 15/836,035, both filed on Dec. 8, 2017 by Eric Scalf, and both incorporated by reference herein. In particular, an icemaking console 70 may be disposed in fresh food compartment 14 and may extend upwardly from a bottom wall 72 of the fresh food compartment 14 only a portion of a height H of the fresh food compartment and spaced apart from each of a top wall 74, right side wall 76, and left side wall 78 of the fresh food compartment. Console 70 may include a front wall 82, top wall 84, right side wall 86 and left side wall 88, and in some instances, at least portions of front wall 82 may be externally-accessible when doors 18, 20 are closed. In some instances, for example, front wall 82 may include a sealing surface 90 against which gaskets 92, 94 on doors 18, 20 may form a seal when doors 18, 20 are closed.

Console 70 may extend in some instances to a back wall 96 of fresh food compartment 14, while in other instances, and as shown in FIG. 4, a separate housing 98 may project from back wall 96 (e.g., formed integrally with back wall 96, or formed as a separate component that is fastened or otherwise attached to back wall 96). Housing 98 may be used, for example, to provide space for an evaporator and/or other cooling system component, for control electronics, for air ducts, or for other suitable purposes.

Moreover, the walls 82, 84, 86 and 88 of console 70 may be insulated (e.g., via foam or another suitable insulator) such that console 70 is an insulated console and such that an interior compartment of console 70 is maintained at a below-freezing temperature for the purposes of making and storing ice. In the illustrated embodiment, console 70 is in fluid communication with freezer compartment 16 through an opening 100 formed in bottom wall 72 of fresh food compartment 14, such that while console 70 is physically disposed within the boundary of fresh food compartment 14, the interior of console 70 is insulated from the fresh food compartment and in fluid communication with freezer compartment 16, thus effectively operating as an extension of freezer compartment 16. In other embodiments, console 70 may be separate from freezer compartment 16, e.g., insulated from freezer compartment 16 and including a separate cooling system, e.g., a thermoelectric cooling system, or separated from freezer compartment 16 but fluidly coupled via ducts or vents to receive cool air circulated by the freezer compartment cooling system. In each instance, however, the interior of console 70 may be considered to be a compartment that is separate from the food storage compartments (fresh food compartment 14 and freezer compartment 16) of refrigerator 10.

Further, it will be appreciated that console 70 is formed separate from the shell or liner used to form the fresh food and/or freezer compartments. In other embodiments, however, console 70 may be formed integrally with the shell or liner of a fresh food and/or freezer compartment.

Console 70 in some embodiments may also provide a convenient location for a control panel 102 suitable for controlling various functions of refrigerator 10. For example, control panel 102 may include displays, buttons, sliders, switches, etc., and may be used to perform various control operations such as setting temperature setpoints, controlling ice and/or water functions, displaying alarms or alerts, etc. As shown in the illustrated embodiment, top wall 84 of console 70 may be bi-level to accommodate control panel 102, although in other embodiments, no control panel may be used, and top wall 84 may be at a substantially consistent elevation along its depth.

Console 70 in some instances may be an icemaking console insofar as the console is used to make, dispense and/or store ice, e.g., as may be produced by an icemaker 103. As will become more apparent below, however, console 70 may not be an icemaking console in some embodiments. In some embodiments, however, console 70 may be configured to receive one or more drawers or storage bins, e.g., upper and lower ice storage bins 104, 106, with an ice dispenser 105 (e.g., a driven auger with selective crushing capability) disposed in upper ice storage bin 104. Upper ice storage bin 104 includes a front face 108 that insulates console 70 from the external environment when the bin is pushed into the console and forms a front surface of the upper ice storage bin, while lower ice storage bin 106 includes a front face 110 that similarly insulates console 70 from the external environment when the bin is pushed into the console and forms a front surface of the lower ice storage bin. Front faces 108, 110 also house at least a portion of an externally-accessible ice and water dispenser, discussed in greater detail below. In some embodiments, a single front face may be used, whereby the upper and lower ice storage bins may be coupled to the same front face.

Beyond ice-related functions, however, console 70 also provides a number of structural features associated with the storage of food items within fresh food compartment 14. For example, side walls 86, 88 of console 70 respectively face side walls 76, 78 of fresh food compartment 14, and may provide structural support for one or more sliding storage elements (e.g., storage elements 112, 114, 116, 118, 120, 122) within fresh food compartment 14. A storage element within the context of the disclosure may include any structural member capable of storing or otherwise supporting a food item, e.g., a shelf, a basket, a storage bin, a drawer, a rack, etc., and a sliding storage element may be considered to be a storage element capable of sliding within a horizontal plane, e.g., along a generally horizontal axis extending from the rear to the front of refrigerator 10.

Storage elements 112 and 118, for example, are sliding shelves, while storage elements 114, 116, 120 and 122 are sliding storage bins or drawers. It will also be appreciated that storage bins or drawers may be configured with customizable environmental conditions (e.g., different temperatures, humidity levels, etc.) suitable for storing food items such as meats, cheeses, vegetables, fruits, etc. Further, not all of storage elements 114-122 need be configured as sliding storage elements, and moreover, different numbers and types of storage elements may be used for any of the storage elements illustrated in FIGS. 3-4, so the invention is not limited to the particular combination of storage elements illustrated herein. Console 70 may also provide structural support for storage elements located above the console, e.g., full width shelf 128, which is disposed underneath a pair of non-sliding shelves 130, 132 (which could also be sliding shelves in some embodiments as well).

Consistent with some embodiments of the invention, and with additional reference to FIG. 1, refrigerator 10 also includes an ice and water system including ice and water dispensers having respective ice dispenser and water dispenser outlets 140, 142 that, while outputting to the same general area (e.g., a dispenser opening 144 defined between doors 18, 20, 22, 24), are separated from one another to the extent that ice dispenser outlet 140 is case-mounted and positioned within dispenser opening 144 to dispense ice from a case-mounted icemaker (icemaker 103), while water dispenser outlet 142 is door-mounted. Furthermore, despite the fact that water dispenser outlet 142 is door-mounted in refrigerator 10, a water dispenser control used to actuate the dispenser may be case-mounted. For example, in some embodiments, a water dispenser may be actuated by a water dispenser button or paddle 146, while in other embodiments, a water dispenser may be actuated by a control that is common to both the water dispenser and the ice dispenser, e.g., a button or paddle 148.

In this regard, and as will become more apparent below, a component may be considered to be door-mounted when the component is mounted to, coupled to, or otherwise movable with a door on a refrigerator that provides access to a food storage compartment (i.e., a compartment in cabinet 12 within which food may be stored, e.g., fresh food compartment 12 or freezer compartment 14). Doors in this regard may be hinged (e.g., as with doors 18, 20) or sliding (e.g., as with doors 22, 24) in various refrigerator designs, and a door-mounted component will generally move with the door upon which it is mounted.

A case-mounted component, on the other hand, is a component that is directly or indirectly mounted to a case, rather than to a door that provides access to a food storage compartment of the refrigerator. A directly mounted case-mounted component may be mounted to a fixed structure in case 12, while an indirectly mounted component may be mounted to another component that is potentially movable relative to a case, but that is not a door that provides access to a food storage compartment of the refrigerator. As but one example, upper and lower ice storage bins 104, 106, and front faces 108, 110 coupled thereto, may be considered to be case-mounted components insofar as these components are supported by a fixed structure in case 12 (console 70) and are not mounted to any door that provides access to a food storage compartment of a refrigerator, despite the fact that they are movable relative to case 12.

In addition, certain components described herein may be referred to herein as being externally-accessible. For the purposes of this disclosure, externally-accessible may be considered to be a component that is accessible to a user when the doors that provide access to the food storage compartments in a refrigerator are in closed positions. Thus, for a door-mounted component, that component may be externally-accessible if the component is accessible on an external surface of the door when the door is in a closed position. For a case-mounted component, however, that component may be externally-accessible if the component is accessible on an external surface of the refrigerator that is not defined on a door that provides access to a food storage compartment. Generally, it will be appreciated that when all of the food storage compartment doors are closed on a refrigerator, the profiles of such doors may define one or more openings between the doors through which case-mounted components may be externally-accessible, e.g., as is the case with opening 144 of FIG. 1.

Figure 5:
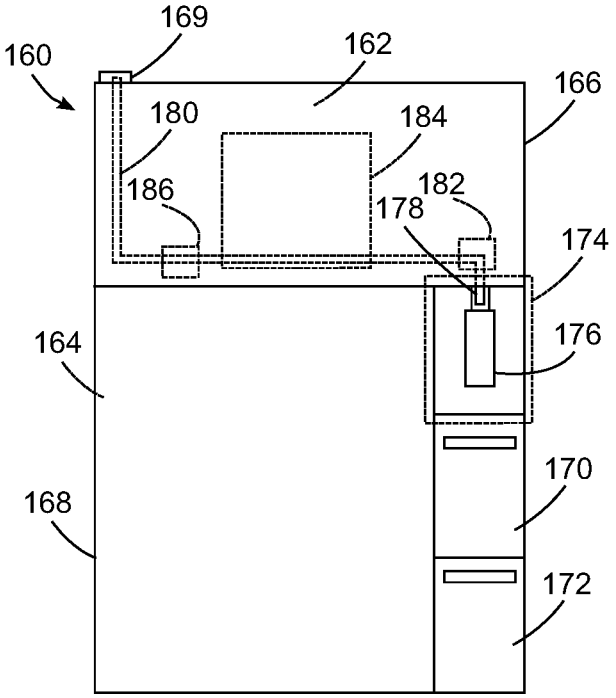
FIG. 5 is a front elevational view of another refrigerator consistent with some embodiments of the invention.

It will be appreciated that food storage compartment doors may define one or more openings of differing dimensions and geometries in different embodiments, and that openings need not be centrally located on a refrigerator as illustrated for refrigerator 10. For example, FIG. 5 illustrates a top mount refrigerator 160 having a freezer compartment 162 disposed above a fresh food compartment 164, and with single hinged doors 166, 168 (hinged along the left side of the refrigerator, e.g., via hinge 169) used to provide access to freezer compartment 162 and fresh food compartment 164, respectively. In addition, while not required, one or more additional doors, such as sliding doors 170, 172, may also be provided on refrigerator 160 to provide quick access to customizable environmental condition storage bins in fresh food compartment 164. Alternately, doors 170, 172 could provide access to separate food storage compartments in some embodiments, e.g., to provide access to food storage compartments that are configurable to store either fresh food or frozen food as a user's storage needs may dictate at different times.

It will be appreciated that doors 166, 168, 170 and 172 define an opening 174 through which a case-mounted component may be externally-accessible. In this regard, opening 174 may be considered to be a dispenser opening, as the opening may be usable to provide external access to one or more dispensers, e.g., an ice, water and/or fluid dispenser, although an opening in other embodiments need not be used for dispensing purposes. In the embodiment illustrated in FIG. 5, for example, opening 174 is used to provide a dispenser recess within which one or more dispenser controls, e.g., a paddle 176, may be disposed. Moreover, consistent with the invention, refrigerator 160 may include a door-mounted fluid or water dispenser outlet 178 that is mounted to (and thus movable with) door 166. In some embodiments, a dispenser control for dispensing fluid such as water from outlet 178 may also be door-mounted, while in other embodiments the control may be case-mounted, e.g., as is the case with paddle 176. Moreover, FIG. 5 illustrates a refrigerator lacking an ice dispenser, although in other embodiments, a case-mounted ice dispenser and ice dispenser outlet could be disposed within opening 174, e.g., where paddle 176 is used for both fluid and ice dispensing based upon a mode selection by a user.

It will therefore be appreciated that an opening through which a case-mounted component may be externally accessible need not be defined on all sides by a plurality of food storage compartment doors. In FIG. 5, for example, a right edge of the opening is not defined by any door. Moreover, it will be appreciated that in some embodiments an opening could be defined by a single door, e.g., where an opening is formed inset from each of the edges of a door, much like a window.

Further, it will be appreciated that while a fluid dispenser outlet 178 is door-mounted, other components in the fluid dispenser itself may be disposed on the door or may be disposed elsewhere in a refrigerator, e.g., case-mounted or mounted on another door. For example, a supply line 180 may be routed through a door in some embodiments, and may be routed through hinge 169 or in other manners known to those of ordinary skill having the benefit of the instant disclosure. A dispensing valve 182 may be door-mounted in some embodiments, while in other embodiments, the dispensing valve may be case-mounted and thus upstream of hinge 169. In addition, in some embodiments it may be desirable to provide one or more fluid storage receptacles or tanks, which may be door-mounted in some embodiments, e.g., as represented by tank 184, or may be case-mounted. A fluid storage receptacle may also be removable in some embodiments and usable as a container or pitcher. Moreover, one or more filters may be door-mounted or case-mounted and in fluid communication with fluid dispenser outlet 178, e.g., as illustrated by filter 186. Other fluid dispenser components may be incorporated into a fluid dispenser as will be appreciated by those of ordinary skill having the benefit of the instant disclosure.

Figure 6:
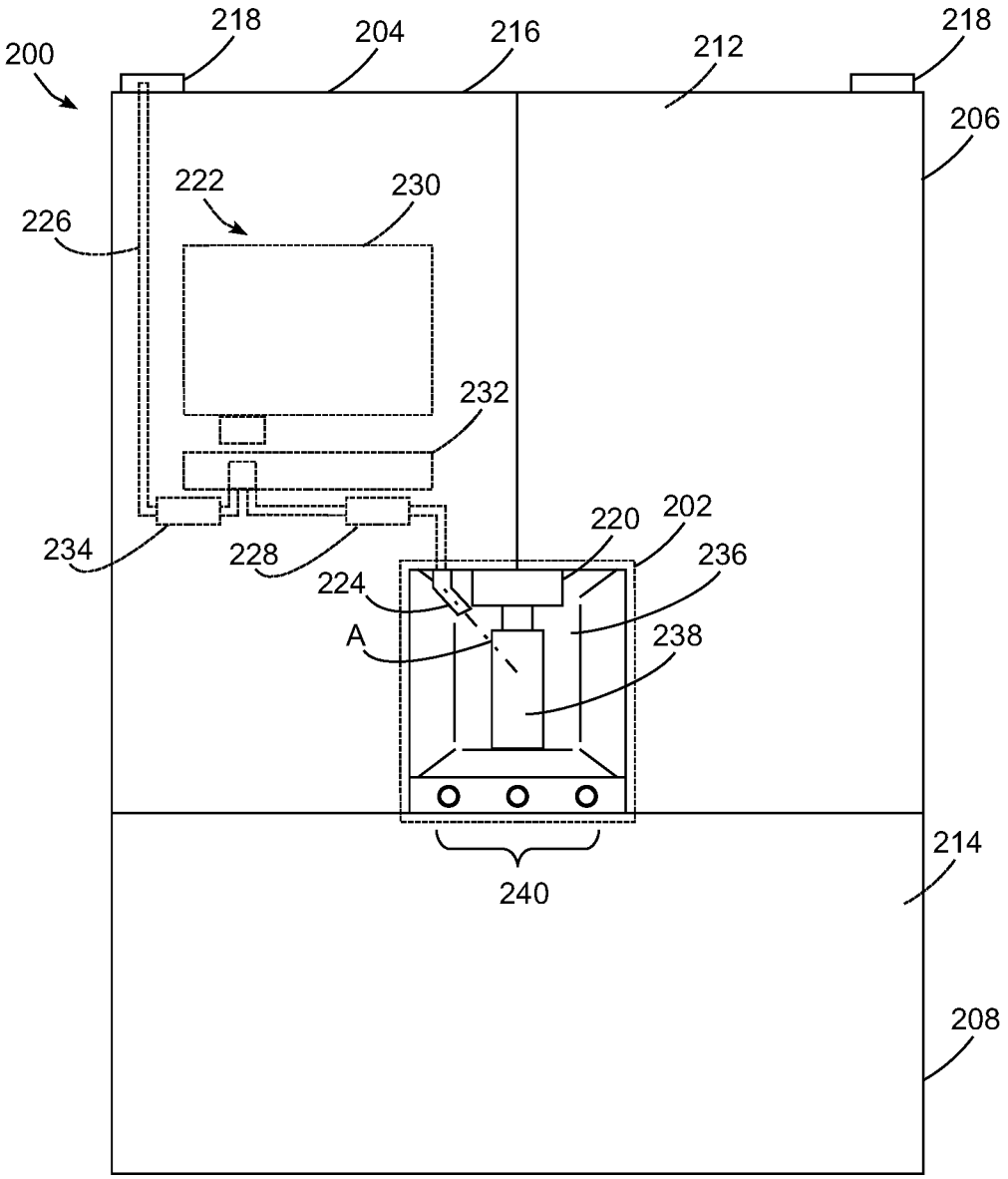
FIG. 6 is a front elevational view of yet another refrigerator consistent with some embodiments of the invention.

Now turning to FIG. 6, this figure illustrates another example refrigerator 200 having a similar bottom mount configuration as refrigerator 10, and also including a central dispenser opening 202 defined by a set of doors 204, 206, 208 providing access to fresh food and freezer compartments 212, 214. Doors 204, 206 are hingedly secured to a case 216 through hinges 218. An ice and water system in refrigerator 200 includes a case-mounted icemaker and ice dispenser disposed in a console (not shown in FIG. 6) configured in a similar manner to refrigerator 10, with an externally-accessible ice dispenser outlet 220 positioned within dispenser opening 202 to dispense ice from the case-mounted icemaker when doors 204, 206, 208 are in a closed position.

In addition, the ice and water system includes a fluid dispenser 222 having an externally-accessible door-mounted fluid dispenser outlet 224 coupled to door 204 to dispense fluid (e.g., chilled water, hot water, coffee and/or another beverage) from the fluid dispenser when doors 204, 206, 208 are in a closed position. Dispenser 222 is fed by a supply line 226 that may be routed through door 204 (e.g., within the insulation) and to case 216 through hinge 218, and a fluid dispensing valve 228 controls the flow of fluid to dispenser outlet 224. As noted above, dispensing valve 228 may be door-mounted in some embodiments, while in other embodiments the dispensing valve may be upstream of hinge 218 and disposed within case 216.

In addition, while in some embodiments fluid dispenser 222 may be configured strictly to dispense fluid provided by supply line 226, in the illustrated embodiment fluid dispenser 222 also includes a door-mounted and removable fluid storage receptacle 230 that removably docks to a dock or support 232 to place an inlet of the fluid storage receptacle 230 in upstream fluid communication with a receptacle fill valve 234 and an outlet of the fluid storage receptacle 230 in downstream fluid communication with dispensing valve 228. Receptacle fill valve 234 is used to control the flow of fluid into receptacle 230 to maintain the receptacle in a substantially full state, and it will be appreciated that various sensors, such as fluid level sensors, may be used to control fill valve 234 to maintain the receptacle in the substantially full state when not dispensing fluid. Both receptacle 230 and dock 232 may be disposed on an inner surface of door 204, or alternatively, within a covered compartment on door 204 that allows for user access when door 204 is open, thereby enabling receptacle 230 to be removed from dock 232 and carried to another location for manual dispensing therefrom. Further, receptacle 230 is desirably, though not necessarily, exposed to the environment of the fresh food compartment such that the fluid in receptacle 230 is maintained at the set temperature in the fresh food compartment.

Also in refrigerator 200, opening 202 is configured to provide a recess 236 for each of the fluid dispenser and the ice dispenser to receive a container in which to dispense a fluid and/or ice, and each of ice dispenser outlet 220 and fluid dispenser outlet 224 are disposed over recess 236 to enable fluid and/or ice to flow downwardly into the container. In this embodiment, a single container-actuated control, e.g., a paddle 238, is disposed in the recess and used to actuate the ice dispenser or the fluid dispenser based upon a mode setting selected via buttons 240. Modes may be selectable for dispensing cubed ice, crushed ice, or water in some embodiments, such that when an appropriate mode is selected and a container is pressed against control 238, the selected ice or fluid will be dispensed into the container. It will be appreciated a control is container-actuated to the extent that it is positioned such that placement of a container against the control positions the container in an appropriate position to receive a dispensed ice or fluid, and it will be appreciated that such a control may be actuated without a container in many instances, e.g., using the hands. Moreover, other types of dispenser controls, whether door-mounted or case-mounted, may be used in other embodiments to control an ice and/or fluid dispenser. In some instances, different controls may be used to separately control ice and fluid dispensers, and these separate controls may be positioned at separate locations, or may be positioned close to one another in various embodiments.

Figure 7:
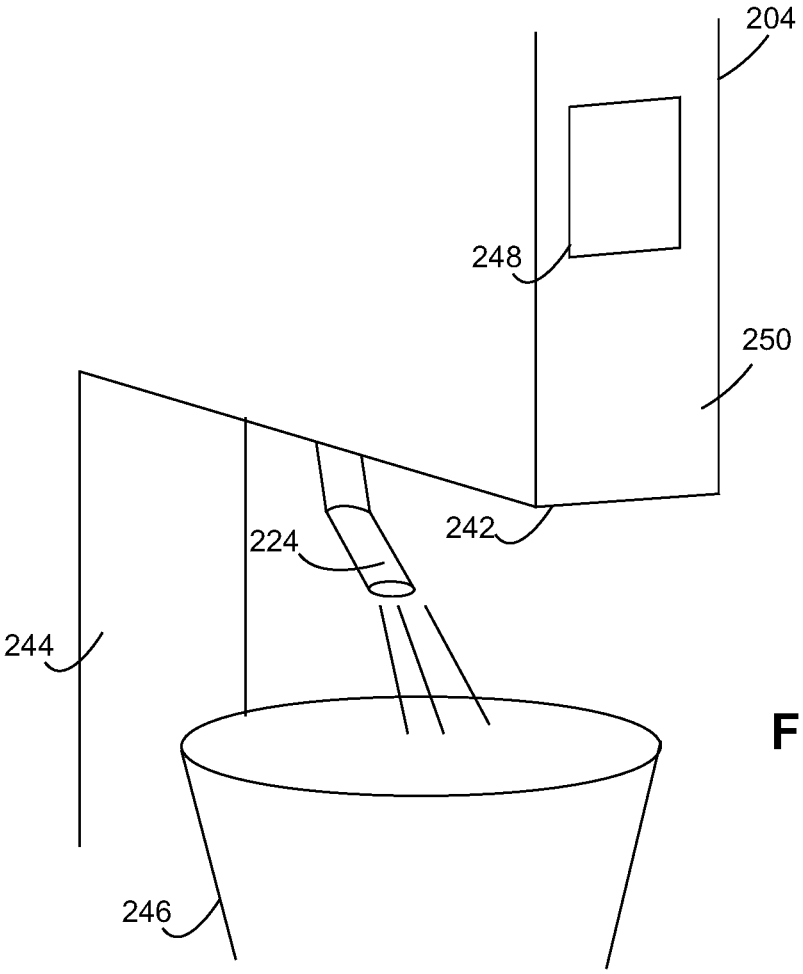
FIG. 7 is an enlarged partial perspective view of a door from the refrigerator of FIG. 6 in an open position, and dispensing fluid into a container.

By virtue of both ice dispenser outlet 220 and fluid dispenser outlet 224 over recess 236, a container may sometimes be placed within recess and may even rest on a shelf during dispensing in some embodiments. This, however, can necessarily limit the size of container that may be received in the recess. In addition, in some embodiments the provision of fluid storage receptacle 230 may enable fluid to be dispensed at a higher rate than that capable of being supplied by a fluid supply at least on a temporary basis, which is generally well suited for dispensing into larger containers, and as such, receptacle 230 may be vented in some embodiments. As a result, and with additional reference to FIG. 7, it may be desirable in some embodiments to configure fluid dispenser outlet 224 on a downwardly-facing side 242 of door 204, and/or to angle at least a portion of outlet 224 to extend in a direction that is generally parallel to a plane of door 204 but projecting outwardly from an end facing side 244 of door 204, e.g., along axis A of FIG. 6. By doing one or both of the aforementioned, outlet 224 may be positioned to dispense into larger containers when door 204 is opened, as illustrated by container 246 of FIG. 7. Furthermore, if desired, a secondary fluid dispenser control, e.g., control 248, may be provided on door 204, e.g., on an end surface 250 thereof, to enable the fluid dispenser to be actuated when the door is open.

In some embodiments, dispenser outlet 224 may be movable, e.g., to rotate and/or redirect the outlet. Further, dispenser outlet 224 may include a coupling in some embodiments to enable a quick release hose to be attached to the outlet whenever it is desirable to dispense at a high dispense rate to quickly fill a container. A fluid dispenser consistent with the invention may also be capable of dispensing at different rates in response to user input, or to dispense a predetermined amount of fluid as specified by a user. Further, in some embodiments, the fluid dispenser outlet may be positioned above a dispenser recess disposed on a door, and as such, in some instances multiple dispenser recesses may be used for dispensing ice and water, respectively.

As such, in the illustrated embodiments a door-mounted fluid dispenser outlet may be used in combination with a case-mounted ice dispenser outlet and/or a case-mounted fluid dispenser control. It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including a case having at least one or more food storage compartments defined therein and at least one or more doors positioned to insulate the at least one or more food storage compartments from an exterior environment, the at least one or more food storage compartments including a fresh food compartment disposed above a freezer compartment, and the at least one or more doors defining a dispenser opening on a front side of the cabinet when the at least one or more doors are in a closed position;

an icemaking console extending upwardly from a bottom wall of the fresh food compartment and positioned proximate the dispenser opening defined by the at least one or more doors, wherein the icemaking console extends only a portion of a height of the fresh food compartment and is spaced apart from each of a top wall, a first side wall, and a second side wall of the fresh food compartment, and wherein the icemaking console includes at least one or more walls that insulate an interior compartment of the icemaking console from the fresh food compartment;

an icemaker disposed within the icemaking console;

an ice dispenser disposed within the icemaking console and having an externally-accessible ice dispenser outlet positioned within the dispenser opening to dispense ice produced by the icemaker when the at least one or more doors are in a closed position;

a water dispenser coupled to the cabinet and having an externally-accessible door-mounted water dispenser outlet coupled to a first door among the at least one or more doors to dispense water from the water dispenser when the at least one or more doors are in a closed position; and an externally-accessible case-mounted water dispenser control coupled to the cabinet and positioned within the dispenser opening to selectively activate the water dispenser in response to user input when the at least one or more doors are in a closed position.

2. A refrigerator, comprising:

a cabinet including a case having at least one or more food storage compartments defined therein and at least one or more doors positioned to insulate the at least one or more food storage compartments from an exterior environment, the at least one or more doors defining an ice dispenser opening on a front side of the cabinet when the at least one or more doors are in a closed position;

an ice dispenser coupled to the cabinet and having an externally-accessible ice dispenser outlet positioned at a predetermined position within the ice dispenser opening to dispense ice from a case-mounted icemaker when the at least one or more doors are in a closed position; and a fluid dispenser coupled to the cabinet and having an externally-accessible door-mounted fluid dispenser outlet coupled to a first door among the at least one or more doors to dispense fluid from the fluid dispenser when the at least one or more doors are in a closed position, wherein the externally-accessible ice dispenser outlet and the externally-accessible door-mounted fluid dispenser outlet are configured such that when the first door is opened, the externally-accessible ice dispenser outlet remains in the predetermined position within the ice dispenser opening while the externally-accessible door-mounted fluid dispenser outlet moves with the first door and away from the ice dispenser opening.

3. The refrigerator of claim 2, wherein the refrigerator is a bottom mount refrigerator, wherein the at least one or more food storage compartments includes a fresh food compartment disposed above a freezer compartment in the case.

4. The refrigerator of claim 3, further comprising an icemaking console extending upwardly from a bottom wall of the fresh food compai linent and positioned proximate the ice dispenser opening defined by the at least one or more doors, wherein the ice dispenser is disposed within the icemaking console.

5. The refrigerator of claim 4, wherein the icemaking console extends only a portion of a height of the fresh food compartment and is spaced apart from each of a top wall, a first side wall, and a second side wall of the fresh food compartment, and wherein the icemaking console includes at least one or more walls that insulate an interior compartment of the icemaking console from the fresh food compartment.

6. The refrigerator of claim 2, wherein the fluid dispenser includes a fluid supply line, a portion of which is routed through the first door.

7. The refrigerator of claim 6, wherein the fluid supply line is further routed through a hinge of the first door that pivotably mounts the first door to the case.

8. The refrigerator of claim 7, wherein the fluid dispenser further includes a fluid dispensing valve disposed upstream of the hinge and configured to dispense fluid through the fluid dispenser outlet when activated.

9. The refrigerator of claim 6, wherein the fluid dispenser further includes a fluid dispensing valve disposed on the first door and configured to dispense fluid through the fluid dispenser outlet when activated.

10. The refrigerator of claim 9, wherein the fluid dispenser further includes:

a fluid storage receptacle disposed on the first door upstream of the fluid dispensing valve; and a receptacle fill valve disposed upstream of the fluid storage receptacle to fill the fluid storage receptacle with fluid when activated.

11. The refrigerator of claim 10, wherein the fluid storage receptacle is dockable into and removable from the first door.

12. The refrigerator of claim 2, further comprising an externally-accessible fluid dispenser control coupled to the cabinet to selectively activate the fluid dispenser in response to user input.

13. The refrigerator of claim 12, wherein the fluid dispenser control is disposed on the first door, wherein the first door includes a fluid dispenser recess configured to receive at least a portion of a container, and wherein the fluid dispenser outlet is disposed above the fluid dispenser recess.

14. The refrigerator of claim 12, wherein the fluid dispenser control is a case-mounted fluid dispenser control positioned within the ice dispenser opening to selectively activate the fluid dispenser in response to user input when the at least one or more doors are in a closed position.

15. The refrigerator of claim 14, wherein the fluid dispenser control includes a container-actuated control positioned for activation by a container when the container is placed below the fluid dispenser outlet.

16. The refrigerator of claim 14, wherein the fluid dispenser control and the fluid dispenser outlet are both disposed proximate the ice dispenser outlet when the first door is in a closed position.

17. The refrigerator of claim 14, wherein the fluid dispenser control further controls the ice dispenser, and wherein the fluid dispenser control selectively activates one of the fluid dispenser and the ice dispenser in response to a user selected mode.

18. The refrigerator of claim 14, further comprising a dispenser recess positioned within the ice dispenser opening to receive at least a portion of a container, wherein the ice dispenser outlet is disposed above the dispenser recess, and wherein the fluid dispenser outlet is positioned over the dispenser recess and proximate the ice dispenser outlet when the first door is in the closed position.

19. The refrigerator of claim 18, wherein the fluid dispenser is further configured to dispense fluid out of the fluid dispenser outlet when the first door is open to facilitate filling of containers that are too large to be received in the dispenser recess.

20. The refrigerator of claim 19, further comprising a secondary fluid dispenser control disposed on the first door to activate the fluid dispenser when the first door is in an open position.

21. The refrigerator of claim 20, wherein the fluid dispenser outlet is disposed on a downwardly-facing side of the first door and includes a portion that dispenses fluid in a direction that is generally parallel to a plane of the first door and outwardly from an end-facing side of the first door.

22. A refrigerator, comprising:

a cabinet including a case having at least one or more food storage compartments defined therein and at least one or more doors positioned to insulate the at least one or more food storage compartments from an exterior environment, the at least one or more doors defining an opening on a front side of the cabinet when the at least one or more doors are in a closed position;

a fluid dispenser coupled to the cabinet and having an externally-accessible door-mounted fluid dispenser outlet coupled to a first door among the at least one or more doors to dispense fluid from the fluid dispenser when the at least one or more doors are in a closed position; and an externally-accessible case-mounted fluid dispenser control coupled to the cabinet and positioned at a predetermined position within the opening to selectively activate the fluid dispenser in response to user input when the at least one or more doors are in a closed position, wherein the externally-accessible case-mounted fluid dispenser control and the externally-accessible door-mounted fluid dispenser outlet are configured such that when the first door is opened, the externally-accessible case-mounted fluid dispenser control remains in the predetermined position within the opening while the externally-accessible door-mounted fluid dispenser outlet moves with the first door and away from the opening.

23. The refrigerator of claim 22, further comprising an ice dispenser coupled to the cabinet and having an externally-accessible ice dispenser outlet positioned within the opening to dispense ice from a case-mounted icemaker when the at least one or more doors are in a closed position.

24. The refrigerator of claim 23, wherein the fluid dispenser control includes a container-actuated control positioned for activation by a container when the container is placed below the fluid dispenser outlet, wherein the fluid dispenser control and the fluid dispenser outlet are both disposed proximate the ice dispenser outlet when the first door is in a closed position.

25. The refrigerator of claim 24, wherein the fluid dispenser control further controls the ice dispenser, and wherein the fluid dispenser control selectively activates one of the fluid dispenser and the ice dispenser in response to a user selected mode.

26. The refrigerator of claim 22, wherein the fluid dispenser comprises:

a fluid supply line, a portion of which is routed through the first door;

a fluid dispensing valve disposed on the first door and configured to dispense fluid through the fluid dispenser outlet when activated;

a fluid storage receptacle disposed on the first door upstream of the fluid dispensing valve; and a receptacle fill valve disposed upstream of the fluid storage receptacle to fill the fluid storage receptacle with fluid when activated.

* * * * *